United States Patent [19]

Montet

[11] Patent Number: 4,614,997

[45] Date of Patent: Sep. 30, 1986

[54] LAMP FIXING AND MOUNTING DEVICE

[75] Inventor: Maurice Montet, Bagnolet, France

[73] Assignee: Cibie Projecteurs, France

[21] Appl. No.: 675,723

[22] Filed: Nov. 28, 1984

[30] Foreign Application Priority Data

Nov. 30, 1983 [FR] France ..... 83 19131

[51] Int. Cl.[4] ..... F21V 19/00; E05D 7/00

[52] U.S. Cl. ..... 362/382; 16/373; 16/380; 362/83

[58] Field of Search ..... 362/83, 80, 257, 269, 362/285, 382, 419; 24/67.7, 160, 489, 517, 518; 16/373, 380, 386

[56] References Cited

U.S. PATENT DOCUMENTS 743,547 11/1903 Nix ..... 24/67.7 X
4,414,614 11/1983 McMahan et al. ..... 362/269

FOREIGN PATENT DOCUMENTS 2925920 3/1980 Fed. Rep. of Germany ..... 362/382
583326 10/1958 Italy ..... 362/382
8386 of 1891 United Kingdom ..... 24/160
1407024 9/1975 United Kingdom ..... 362/287

*Primary Examiner*—Tony M. Argenbright
*Attorney, Agent, or Firm*—McCormick, Paulding & Huber

[57] ABSTRACT

The device is of the type comprising a lamp-supporting ring (10) having an opening for receiving the base of a lamp, and a clip (30) in the form of a loop of wire which is pivotally mounted to one side of the said opening to pivot between an open position in which the opening is clear and a closed position in which the clip locks a lamp in position. The device includes the improvement wherein a first end (32) of the said wire is pivotally mounted in at least one bearing (16) provided on the said one side of the ring, and wherein the opposite end of the clip (40) is so shaped as to present a cradle suitable for receiving a portion of the first end and for being itself received, when the clip is in the closed position, in a recess (42) provided in the ring. The device is particularly intended for use in car headlights.

10 Claims, 5 Drawing Figures

LAMP FIXING AND MOUNTING DEVICE

The present invention relates generally to a device for mounting and for fixing a lamp on its support, and more particularly to a device for mounting and fixing a lamp in a motor vehicle headlight.

BACKGROUND OF THE INVENTION

At present, lamps are placed in motor vehicle headlights by means of a lamp base which is engaged in a support ring, and they are then locked in place by means of at least one spring clip which is pivotally mounted on the support ring and which is clamps the base to the ring. However, current spring clips present several drawbacks due to their structure. Firstly, prior art spring clips are not sufficiently rigid in the clamping position to ensure entirely reliable retention of the lamp. Secondly, an extra assembly operation is required when fitting prior art spring clips to their associated support rings in order to ensure that the spring clips are not lost, e.g. when changing lamps. Finally, spring clips are delivered in bulk in the form of open wire loops in a box thereby entailing considerable loss of time on an assembly line since the clips have a marked tendency to tangle with one other and the assembley worker thus has to waste time untangling them before mounting them on support rings.

Preferred embodiments of the present invention mitigate these drawbacks by providing clips which are easy to mount without requiring any extra assembly operation to prevent them from getting lost, which remain tightly clamped when closed against the associated support ring without risk of accidentally opening, and which show no tendency to tangle when stored in bulk in a box.

SUMMARY OF THE INVENTION

The present invention provides a lamp fixing and mounting device for fixing and mounting an electric lamp, the device being of the type comprising a lamp-supporting ring having an opening for receiving the base of a lamp, and a clip in the form of a loop of wire which is pivotally mounted to one side of the said opening to pivot between an open position in which the opening is clear and a closed position in which the clip locks a lamp in position, the device including the improvement wherein a first end of the said wire is pivotally mounted in at least one bearing provided on the said one side of the ring, and wherein the opposite end of the clip is so shaped as to present a cradle suitable for receiving a portion of the first end and for being itself received, when the clip is in the closed position, in a recess provided in the ring.

BRIEF DESCRIPTION OF THE DRAWINGS

Embodiments of the invention are described by way of example with reference to the accompanying drawings, in which.

MORE DETAILED DESCRIPTION

Figure 1:
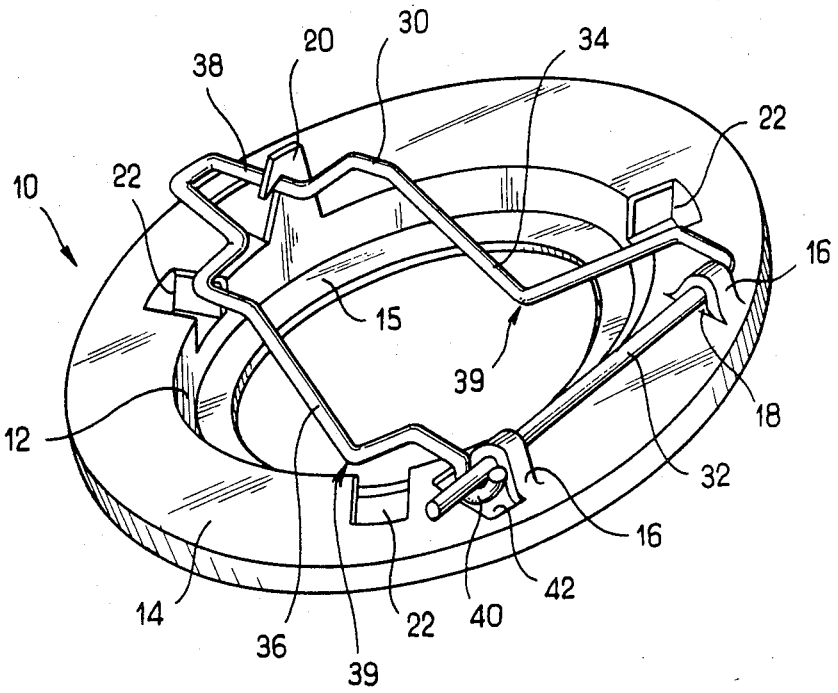
FIG. 1 is a perspective view of a mounting and fixing device in accordance with the invention.

With reference to FIG. 1, the lamp fixing device in accordance with the invention comprises a ring 10, e.g.

a metal stamping, in the form of a short cylindrical sleeve 12 defining an opening for receiving the base of a lamp for a vehicle headlight, the opening is surrounded by a generally plane, outwardly directed "upper" flange 14 and by an inwardly directed "lower" flange 15 which provides a bearing surface for a corresponding flange on the lamp base. Terms describing vertical directions (such as "upper" and "lower") are used in this description with respect to the orientation shown in the figures in which the lamp fixing device is shown ready to receive a lamp which is inserted downwardly. Naturally, when mounted in a vehicle headlight, the fixing device would normally receive a lamp along a nearly horizontal axis.

The support ring 10 is normally fixed to the headlight reflector (not shown). The device illustrated is suitable for receiving lamps of the H4 type in which the lamp base has a flange for engaging the flange 15 and three coplanar tabs fitted above the flange extending radially from the base to engage corresponding notches 22 in the support ring and thereby fix the axial position of the lamp.

Two bearings are provided on the upper face of the upper flange 14 and to one side of the central opening. Each of these bearings is in the form of an upwardly extending arch 16 defining a passage 18, with the two passages 18 sharing a common axis extending parallel to the plane of the upper flange 14. On the other side of the central opening, the ring 10 has a hook 20 projecting upwardly from the junction between the cylinder 12 and the upper flange 14. As outlined above there are three notches 22 in the ring formed at the level of the junction between the cylinder 12 and the upper flange 14 and intended for receiving tabs to correctly position the base of an H4 lamp.

The fixing device in accordance with the invention also has a clip 30 constituted by rigid and elastic wire, e.g. made of spring steel, which is suitably bent into shape as shown in the drawings. This shape constitutes part of the invention. A first end 32 of the wire is substantially rectilinear and is pivotally mounted in the bearing arches 16 on the upper flange 14. The passages 18 are of slightly larger diameter than the diameter of the wire. The clip further includes two main arms 34 and 36 which are substantially parallel to each other and which extend across the opening from the bearings towards the hook 20. At the hook end of the clip, the wire joining the two arms is suitably shaped at 38 to engage the hook 20. The other end 40 of the wire, opposite to its end 32, is in the shape of a semicircle constituting a cradle for receiving the first end 32 of the wire close to its free tip. The size and shape of the clip and its end semicircle are such that the cradle is pressed resiliently against the first end 32 when the end 32 is received in the cradle. As can be seen in FIG. 1 which shows the device in the closed position, the cradle 40 projects downwardly from the first end 32 and is received in a recess 42 provided for this purpose in the ring 10. The recess is adjacent to the bearing 16 which is furthest to the left in the figure. The clip 30 is thus effectively locked in place and the arm 36 (i.e. the arm which is terminated by the cradle) is prevented from moving thus ensuring reliable engagement with a lamp. As explained below, the semicircular cradle 40 also serves to prevent the clip 30 from coming apart from the ring 10 when the fixing device is in the open position.

In a manner known per se, the arms 34 and 36 are given a shape which is suitable for satisfactory retention of the lamp base in the opening. The lamp is pressed against the inner flange 15 by the elbow-shaped kinks 39 in each of the arms.

Reference is now made to FIGS. 2A to 2D which show the sequence of operations for assembling the clip on the ring. The embodiment of the fixing device shown in these figures is slightly different from that shown in FIG. 1 in that the shape of the hook-engaging end 38 of the clip is different, and that the ring 10 is shown with two hooks in FIGS. 2A to 2D instead of just one as in FIG. 1.

The clip is delivered in the form of a closed loop, i.e. the two ends 32 and 40 of the wire are engaged so that there is no risk of clips stored in bulk in a box becoming entangled with one another. An assembly line worker can thus take clips out of the box without loosing time to untangle them.

Figure 2A:
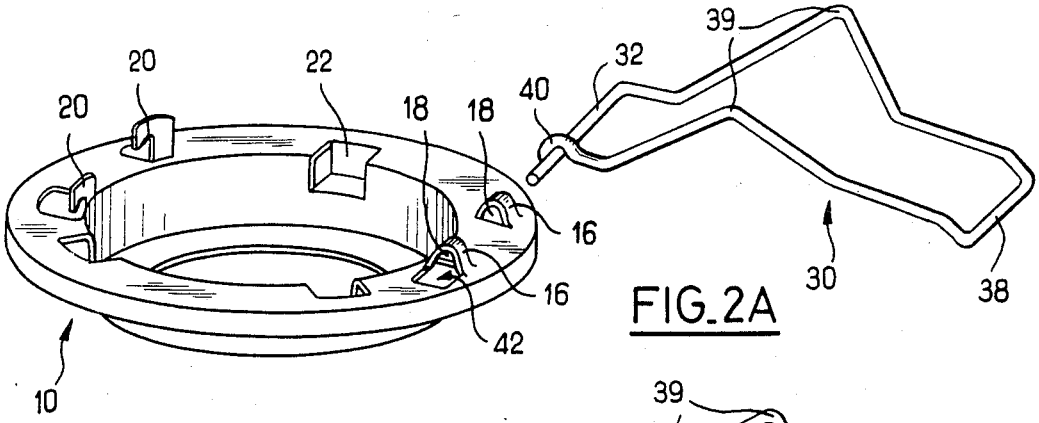
FIGS. 2A to 2D are perspective views of a fixing device similar to the FIG. 1 device, and showing successive stages in the assembly of the device.
Figure 2B:
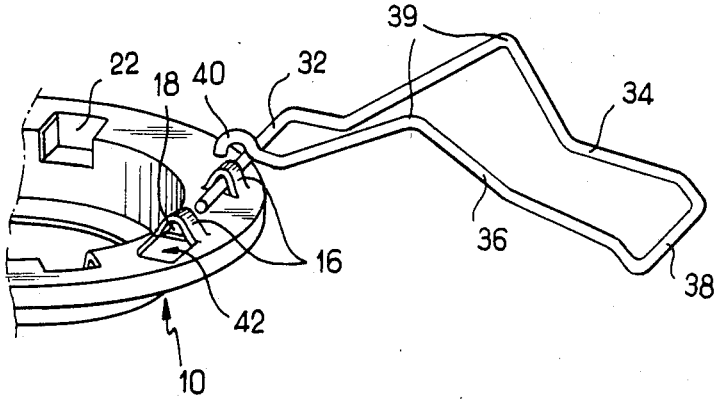
Figure 2C:
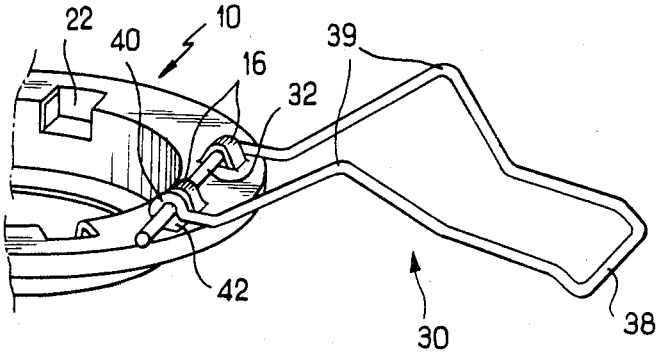
Figure 2D:
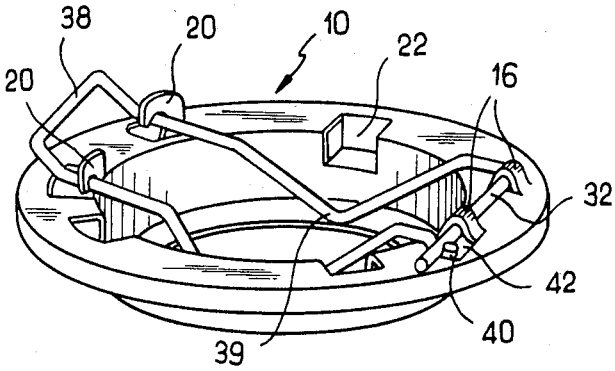

To assemble a clip to a ring, the first end portion 32 of the clip is initially aligned with the common axis of the passages 18 of the ring (FIG. 2A), and then the worker lifts the other end 40 off the rectilinear first end 32 so as to be able to slide the first end 32 through the passages 18 under the arches 16 (FIG. 2B). Once the rectilinear first end 32 is in place in both of the hinges 16–18, the worker releases the other end 40 which springs back into resilient contact with the tip of the end 32 projecting beyond the second hinge. It can thus be seen (FIG. 2C) that even in the open position, once the end 40 has been released and has taken up its normal position pressed against the the tip of the rectilinear end 32, there is no danger of the clip becoming accidentally removed from the ring. FIG. 2D shows the fixing device of FIGS. 2A to 2C in the closed position after pivoting through about 180° in the hinges. As can be seen, the fact of pivoting the clip through 180° causes the cradle at the end 40 to enter the recess 42 in the ring 10 adjacent to one of the hinges 16, thereby preventing the associated arm 35 from moving sideways, and thus ensuring that a lamp (not shown) is effectively and reliably retained in the ring 10 by the clip 30.

Naturally the present invention is not limited to the embodiments described in detail and shown in figures, and numerous modifications may be made thereto by the person skilled in the art without going beyond the scope of the claims. In particular, the shape of the ring and of the clip can readily be adapted to many other types of lamp.

I claim:

1. A lamp fixing and mounting device for fixing and mounting an electric lamp, the device being of the type comprising a lamp-supporting ring having an opening for receiving the base of a lamp, and a clip in the form of a loop of wire which is pivotally mounted to one side of the said opening to pivot between an open position in which the opening is clear and a closed position in which the clip locks a lamp in position, the device including the improvement wherein a first end of the said wire is pivotally mounted in at least one bearing provided on the said one side of the ring, and wherein the opposite end of the clip is so shaped as to present a cradle suitable for receiving a portion of the first end and for being itself received, when the clip is in the closed position, in a recess provided in the ring.

2. A device according to claim 1, wherein the cradle at said opposite end is curved in the shape of a semicircle.

3. A device according to claim 1, wherein the wire of the clip is prestressed in such a manner as to press its cradle end resiliently against its said first end.

4. A device according to claim 1, wherein the wire of the clip is made of spring steel.

5. A device according to claim 1, wherein the ring has two bearing arches through which the said first end of the clip is engaged to act as a hinge pin for the clip.

6. A device according to claim 1 wherein a lamp is a vehicle headlight.

7. A device according to claim 2 wherein a lamp is a vehicle headlight.

8. A device according to claim 3 wherein a lamp is a vehicle headlight.

9. A device according to claim 4 wherein a lamp is a vehicle headlight.

10. A device according to claim 5 wherein a lamp is a vehicle headlight.

* * * * *